US009134026B2

(12) United States Patent
Blaauwwiekel et al.

(10) Patent No.: US 9,134,026 B2
(45) Date of Patent: Sep. 15, 2015

(54) METHOD FOR OPERATING A GAS BURNER

(71) Applicant: Honeywell Technologies Sarl, Rolle (CH)

(72) Inventors: Piet Blaauwwiekel, Sleen (NL); Erik G. E. Gankema, Roswinkel (NL)

(73) Assignee: Honeywell Technologies Sarl, Rolle (CH)

( * ) Notice: Subject to any disclaimer, the term of this patent is extended or adjusted under 35 U.S.C. 154(b) by 294 days.

(21) Appl. No.: 13/669,831

(22) Filed: Nov. 6, 2012

(65) Prior Publication Data

US 2013/0115563 A1 May 9, 2013

(30) Foreign Application Priority Data

Nov. 7, 2011 (DE) ..... 10 2011 117 736

(51) Int. Cl.
*F23N 1/02* (2006.01)
*F23N 5/18* (2006.01)
(Continued)

(52) U.S. Cl.
CPC ..... *F23N 1/022* (2013.01); *F23D 14/02* (2013.01); *F23D 14/60* (2013.01); *F23N 3/082* (2013.01);
(Continued)

(58) Field of Classification Search
CPC ..... F23D 14/60; F23D 14/02; F23N 1/027; F23N 1/022; F23N 3/087; F23N 3/085; F23N 3/082; F23N 5/184; F23N 2023/08; F23N 2025/06; F23N 2035/16
USPC ..... 431/12, 19, 89, 90
See application file for complete search history.

(56) References Cited

U.S. PATENT DOCUMENTS 3,299,940 A * 1/1967 Phillips et al. ..... 137/606
3,782,120 A * 1/1974 Brandenburg ..... 60/524
(Continued)

FOREIGN PATENT DOCUMENTS

DE 19922226 11/2000
DE 101014901 10/2002
(Continued)

OTHER PUBLICATIONS

"DE_10114901_C1_M—Machine Trans.pdf"; Machine translation for DE-10114901; http://www.epo.org; Oct. 1, 2014.*
(Continued)

*Primary Examiner* — Steven M McAllister
*Assistant Examiner* — Daniel E Namay
(74) *Attorney, Agent, or Firm* — SeagerTufte & Wickhem LLC

(57) ABSTRACT

Method for operating a gas burner, wherein a gas/combustion air mixture is fed to the gas burner for combusting in said gas burner in such a way that a combustion air flow, which is inducted by a fan, is mixed with a gas flow and the resulting gas/combustion air mixture is fed to the gas burner, wherein to this end a control device, on the basis of a control deviation between an actual value, which is recorded by a sensor providing an electrical or electronic measurement signal and acting on a gas line which carries the gas flow, and a corresponding reference value, determines a manipulated variable for a gas valve which influences the gas flow, wherein the gas valve is adjusted in dependence upon this manipulated variable in order to make available to the gas burner the gas/combustion air mixture with a desired gas/combustion air ratio, and wherein the control device alters the gas/combustion air ratio of the gas/combustion air mixture in dependence upon a rotational speed of the fan in such a way that at relatively low rotational speeds of the fan in comparison to relatively high rotational speeds of the fan the gas proportion is reduced in relation to the air proportion so that the gas/combustion air ratio becomes leaner in gas.

14 Claims, 2 Drawing Sheets

Figure 1:
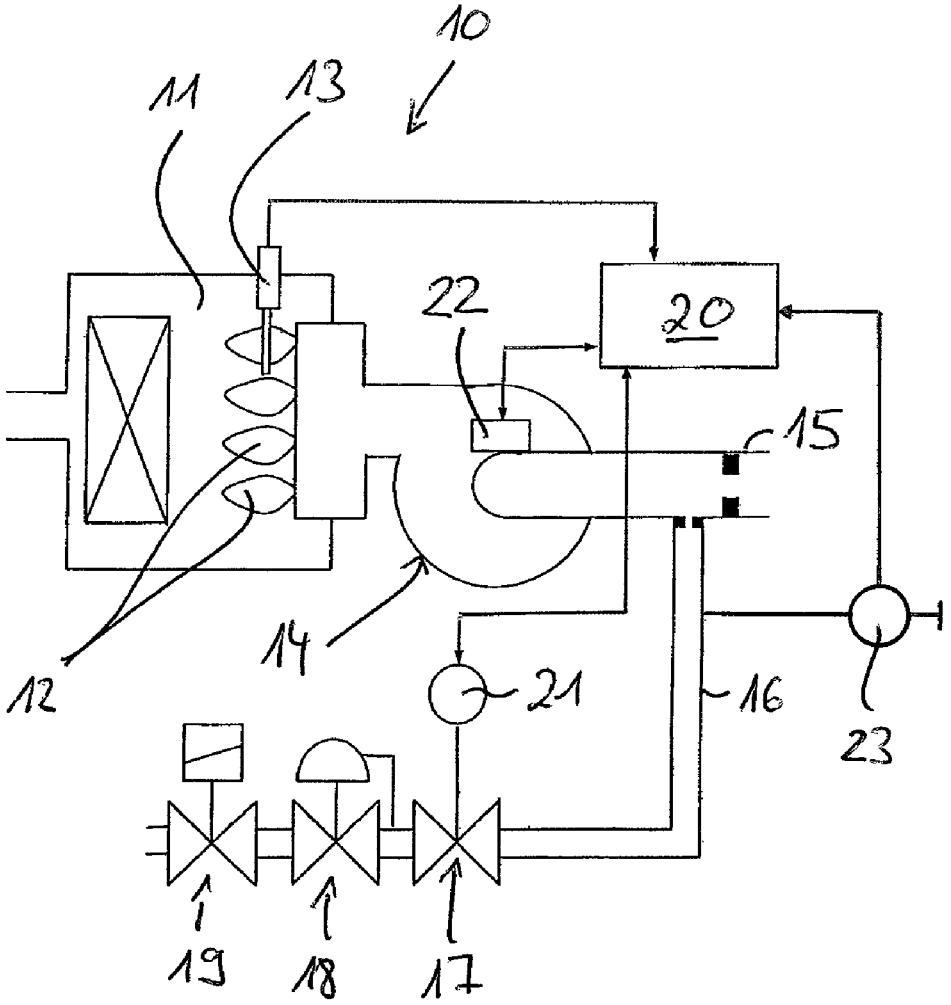

(51) Int. Cl.

| | |
|---|---|
| ***F23D 14/02*** | (2006.01) |
| *F23N 3/08* | (2006.01) |
| *F23N 5/02* | (2006.01) |
| *F23D 14/60* | (2006.01) |

(52) U.S. Cl.

CPC ..... *F23N 3/085* (2013.01); *F23N 5/184* (2013.01); *F23N 2025/06* (2013.01); *F23N 2033/08* (2013.01); *F23N 2035/16* (2013.01)

(56) References Cited

U.S. PATENT DOCUMENTS

| | | | | |
|---|---|---|---|---|
| 3,832,848 | A * | 9/1974 | Scholl | 60/274 |
| 4,256,044 | A * | 3/1981 | Burton | 110/104 R |
| 4,424,793 | A | 1/1984 | Cooperrider | |
| 4,998,877 | A | 3/1991 | Schilling et al. | |
| 6,213,758 | B1 | 4/2001 | Tesar et al. | |
| 6,764,298 | B2 | 7/2004 | Kim et al. | |
| 6,939,127 | B2 | 9/2005 | Goebel | |
| 7,223,094 | B2 | 5/2007 | Goebel | |
| 8,286,594 | B2 | 10/2012 | Smelcer | |
| 2002/0150850 | A1 | 10/2002 | Kim et al. | |
| 2008/0118877 | A1 | 5/2008 | Min | |
| 2009/0197212 | A1 | 8/2009 | Masen | |
| 2010/0095905 | A1 | 4/2010 | Smelcer | |
| 2010/0126431 | A1 * | 5/2010 | Kanda et al. | 122/14.21 |
| 2010/0143853 | A1 | 6/2010 | Cohen | |
| 2011/0070550 | A1 * | 3/2011 | Arensmeier | 431/12 |
| 2011/0139045 | A1 * | 6/2011 | Zatti et al. | 110/188 |
| 2011/0269082 | A1 | 11/2011 | Schultz | |
| 2012/0058439 | A1 * | 3/2012 | Munsterhuis et al. | 431/12 |
| 2012/0115093 | A1 * | 5/2012 | Yamashita et al. | 431/12 |
| 2012/0180774 | A1 * | 7/2012 | Reifel et al. | 126/116 R |
| 2012/0192813 | A1 * | 8/2012 | Evans et al. | 122/20 B |
| 2013/0230812 | A1 * | 9/2013 | Schultz et al. | 431/12 |
| 2013/0305967 | A1 * | 11/2013 | Ma et al. | 110/189 |
| 2013/0318968 | A1 * | 12/2013 | Juranitch et al. | 60/645 |
| 2014/0000235 | A1 * | 1/2014 | Kamen et al. | 60/39.6 |

FOREIGN PATENT DOCUMENTS

| | | | | | |
|---|---|---|---|---|---|
| DE | 102005034758 | B3 * | 8/2006 | | F23N 1/02 |
| EP | 1944549 | A2 * | 7/2008 | | F23N 1/02 |
| EP | 1944550 | A2 * | 7/2008 | | F23N 5/18 |
| EP | 2090827 | A2 | 8/2008 | | |
| JP | 58224225 | A * | 12/1983 | | F23N 5/02 |
| JP | 58224228 | A * | 12/1983 | | F23N 5/02 |
| JP | 59069612 | A * | 4/1984 | | F23N 5/02 |
| JP | 04028910 | A * | 1/1992 | | F23D 14/62 |
| WO | WO 9963272 | A1 * | 12/1999 | | F23N 1/02 |
| WO | WO 9963273 | A1 * | 12/1999 | | F23N 1/02 |

OTHER PUBLICATIONS

International Search Report for Corresponding No. EP 12189554 dated Feb. 20, 2013.

* cited by examiner

METHOD FOR OPERATING A GAS BURNER

This application claims priority to German Patent Application No. 10 2011 117 736.5, entitled "Method for Operating a Gas Burner", which is incorporated herein by reference.

The invention relates to a method for operating a gas burner. The invention also relates to a control device for a gas burner.

A method for operating a gas burner is known from EP 1 944 550 A2, wherein a gas/combustion air mixture is fed to the gas burner for combusting. A fan or a blower inducts combustion air for this purpose, wherein a gas flow is mixed with the inducted combustion air flow and introduced via a gas line and a gas nozzle in the region of the combustion air line into the combustion air flow. According to this prior art, a sensor, which provides an electrical or electronic measurement signal, is connected between the gas line which carries the gas flow and the combustion air line which carries the combustion air, wherein a control device, on the basis of the electrical or electronic measurement signal of the sensor, generates an actuating signal for a gas valve which is allocated to the gas line in order to make available to the gas burner the gas/combustion air mixture with a desired gas/combustion air ratio in the terms of a 1:1 gas/air control. In this case, the gas/combustion air mixture which is to be fed to the gas burner for combusting is influenced in such a way that a pressure ratio between the gas pressure in the gas line and the combustion air pressure in the combustion air line is 1:1.

A method for operating a gas burner is also known from EP 2 090 827 A2, in which the control device, on the basis of an electrical or electronic measurement signal of a sensor, generates an actuating signal for a gas valve which is allocated to a gas line. According to this prior art, however, the sensor which provides the electrical or electronic measurement signal is not connected between the gas line and the combustion air line, on the contrary according to this prior art the sensor, which provides the electrical or electronic measurement signal, on the one hand acts on the gas line and on the other hand acts on a reference pressure, wherein the reference pressure preferably corresponds to the combustion air pressure. Also in this case, a gas/combustion air mixture in terms of a 1:1 gas/air control is made available to the gas burner so that the pressure ratio between the combustion air pressure and the gas pressure is 1:1 accordingly.

In the case of this method for operating a gas burner which is known from the prior art, in which the control device generates the actuating signal for the gas valve on the basis of an electrical or electronic measurement signal of a sensor, the ratio of gas and combustion air in the gas/combustion air mixture is kept constant over the entire modulation range of the gas burner, that is to say independently of the rotational speed of the fan. A modulation of 1 corresponds to a full-load rotational speed of the fan and a modulation of 5 corresponds to 20% of the full-load rotational speed of the fan. As already explained, according to the prior art the ratio of gas and combustion air in the gas/combustion air mixture in terms of a 1:1 gas/air control is kept constant within the entire modulation range.

Starting from here, the invention is based on creating a novel method for operating a gas burner and a novel control device for a gas burner.

According to the invention, the control device alters the gas/combustion air ratio of the gas/combustion air mixture in dependence upon a rotational speed of the fan in such a way that at relatively low rotational speeds of the fan in comparison to relatively high rotational speeds of the fan the gas proportion is reduced in relation to the air proportion so that the gas/combustion air ratio becomes leaner in gas.

With the present invention here, with a method for operating a gas burner in which the control device generates the manipulated variable for the gas valve in dependence upon an electrical or electronic measurement signal of a sensor, it is initially proposed to alter the gas/combustion air ratio of the gas/combustion air mixture to be fed to the gas burner in dependence upon the rotational speed of the fan and therefore over the modulation range of the gas burner, specifically in such a way that at relatively low rotational speeds of the fan in comparison to relatively high rotational speeds of the fan the gas proportion is reduced in relation to the air proportion in the gas/combustion air mixture so that said mixture becomes leaner in gas. As a result, at relatively low rotational speeds of the fan, that is to say during partial load operation of the gas burner, it is possible to reduce gas emissions, especially NOx emissions.

According to a first advantageous development of the invention, to this end the control device alters the reference value in dependence upon the rotational speed of the fan. According to a second advantageous development of the invention, to this end the control device alters the manipulated variable in dependence upon the rotational speed of the fan.

With both advantageous developments, which can be used preferably alternatively, but also in combination with each other, the altering of the composition of the gas/combustion air mixture can be realized in a particularly simple manner in dependence upon the rotational speed of the fan.

Figure 2:
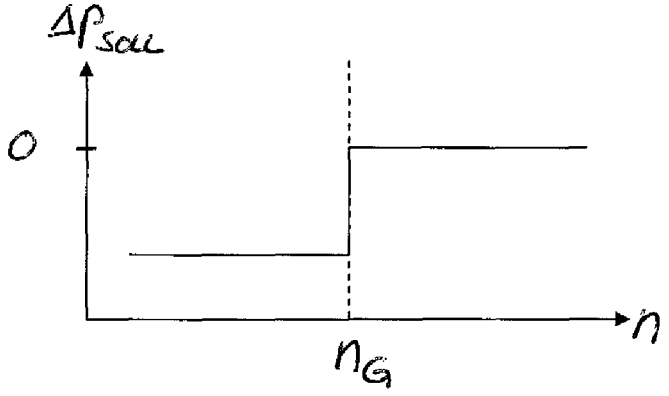
Figure 3:
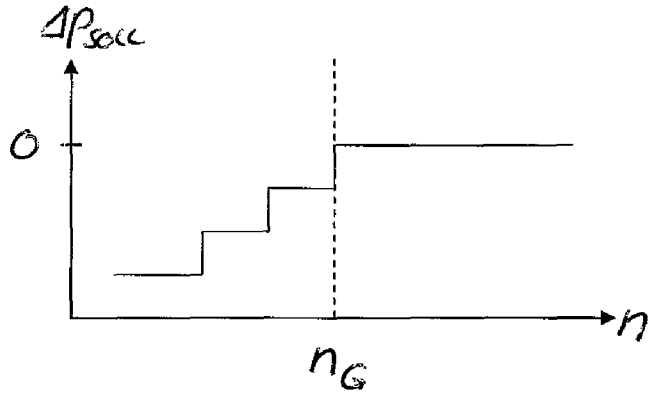
Figure 4:
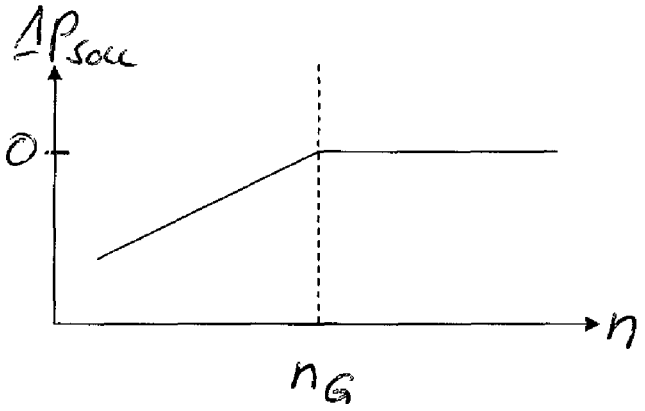

Preferred developments of the invention are gathered from the claims and from the subsequent description. Exemplary embodiments of the invention are subsequently explained in more detail with reference to the drawing, without being limited thereto. In the drawing:

FIG. 1: shows a block diagram of a gas burner;

FIG. 2: shows a first diagram for further illustration of the invention;

FIG. 3: shows a second diagram for further illustration of the invention; and FIG. 4 shows a third diagram for further illustration of the invention.

The present invention here refers to a method for operating a gas burner and also to a control device for a gas burner.

FIG. 1 schematically shows a gas burner 10, wherein a gas/combustion air mixture is fed to a combustion chamber 11 of the gas burner 10 for combusting. During the combustion of the gas/combustion air mixture in the combustion chamber 11 of the gas burner 10, a flame 12 is formed in the combustion chamber 11, into which flame an ionization sensor 13 can project, by means of which the forming of the flame 12 in the combustion chamber 11 can be monitored. The gas/combustion air mixture to be fed to the combustion chamber 11 of the gas burner 10 is formed from the mixing of a gas flow with a combustion air flow, wherein a blower or fan 14 inducts the combustion air flow via a combustion air line 15. The combustion air is mixed with gas, wherein the gas is delivered via a gas line 16 in the direction of the combustion air line 15.

A gas valve 17 is integrated into the gas line 16, wherein the composition of the gas/combustion air mixture can be adjusted via said gas valve 17. The quantity of gas/combustion air mixture to be fed to the gas burner is adjusted via the fan 14.

In addition to the gas valve 17, additional gas valves 18, 19, as safety valves, can be integrated into the gas line 16.

A control device 20 is associated with the gas burner 10 in order to control and/or to regulate the operation of the gas burner 10. To this end, the procedure is such that the control device 20, on the basis of a control deviation between an actual value and a reference value, determines a manipulated variable for the gas valve 17 which influences the gas flow, specifically for an actuator 21 of the gas valve 17, in order to make available to the gas burner 11 the gas/combustion air mixture with a desired composition or a desired gas/combustion air ratio. The actual value, on the basis of which the gas control device 20 generates the manipulated variable for the actuator 21 of the gas valve 17, is provided by a sensor 23 which generates an electrical or electronic measurement signal on the basis of a pressure difference between a gas pressure and a combustion air pressure. To this end, the sensor 23 in the preferred exemplary embodiment of FIG. 1 on the one hand acts on the gas line 16, in which the gas pressure prevails, and on the other hand acts on a reference point, at which a reference pressure prevails, wherein the reference pressure corresponds to the combustion air pressure. The electrical or electronic measurement signal provided by the sensor 23, or the actual value provided by it, corresponds accordingly to a current pressure difference between the actual combustion air pressure and the actual gas pressure, wherein the control device 20 compares this actual value with a corresponding reference value and creates the manipulated variable for the actuator 21 of the gas valve 17 on the basis of the control deviation between the actual value and the reference value. It can also be gathered from FIG. 1 that the control device 20 also creates a manipulated variable for an actuator 22 of the fan 14 in order to influence the rotational speed of the fan 14. The rotational speed of the fan 14 can be varied within a defined modulation range of the gas burner 10, wherein a modulation of 1 corresponds to the full-load rotational speed of the fan 14 and a modulation of 5 corresponds to 20% of the full-load rotational speed of the fan.

According to the invention, the control device 20 alters the gas/combustion air ratio of the gas/combustion air mixture in dependence upon the rotational speed of the fan 14 in such a way that at relatively low rotational speeds of the fan 14 in comparison to relatively high rotational speeds of the fan the gas proportion is reduced in relation to the air proportion in the gas/combustion air mixture so that the gas/combustion air mixture becomes leaner in gas. According to the invention, the composition of the gas/combustion air mixture is therefore not constant over the modulation range of the gas burner 10, rather the composition of the gas/combustion air mixture is altered over the modulation range of the gas burner, specifically in such a way that at relatively low rotational speeds of the fan 14 the mixture becomes leaner in gas.

According to a first variant of the invention, to this end the control device 20, in dependence upon the rotational speed of the fan 14, can alter the reference value which is compared to the actual value which is provided by the sensor 23. According to a second variant, to this end the control device 20 can alter the manipulated variable for the actuator 21 of the gas valve 17 in dependence upon the rotational speed of the fan.

According to an advantageous variant of the invention, when the rotational speed of the fan 14 is greater than a limit value, a 1:1 gas/air control, that is to say with a pressure ratio of gas pressure to combustion air pressure of 1:1, is provided by means of the control device 20 so that no mass flow therefore flows through the sensor 23, which is preferably designed as an anemometer.

With a pressure ratio of 1:1 between the gas pressure and the combustion air pressure, the actual value is therefore zero, wherein the control device 20 controls the actuator 21 of the gas valve 17 in such a way that the actual value measured by the sensor 23 is zero, that is to say corresponds to the corresponding reference value.

However, when the rotational speed of the fan 14 is lower than the limit value, a 1:N gas/air control is provided by means of the control device 20 with a ratio of gas pressure to combustion air pressure of 1:N, wherein N is greater than 1. To this end, as already explained, either the reference value for the control device 20 or the manipulated variable for the actuator 21 of the gas valve 17 can be adjusted in dependence upon the rotational speed of the fan 14.

The limit value for the rotational speed of the fan 14, after the falling short of which the 1:1 gas/air control is abandoned and the gas proportion of the gas/combustion air mixture is reduced in relation to the air proportion of the mixture, lies particularly between 20% and 50% of the full-load rotational speed of the fan 14, that is to say between a modulation of 5 and 2. Especially preferred is a variant of the invention in which the limit value for the rotational speed of the fan 14, after the falling short of which the change to 1:N gas/air control takes place, lies between 30% and 40% of the full-load rotational speed of the fan 14.

When the control device 20 alters the reference value, with the falling short of the limit value for the fan 14, controlling is no longer carried out to a zero throughflow at the sensor 23 but to a throughflow from the reference point in the direction of the gas line 16, that is to say to a negative value.

When the control device 20 adjusts the manipulated variable for the actuator 21 of the gas valve 17, with the falling short of the limit value for the rotational speed of the fan 14, the manipulated variable which is actually generated for the 1:1 gas/air control is compensated with a negative offset value in order to reduce the gas proportion.

When the rotational speed of the fan 14 is higher than the limit value, the control device, via the manipulated variable for the actuator 21 of the gas valve 17, provides a gas/combustion air mixture with a gas/combustion air ratio which ensures a combustion in the gas burner 10, specifically in the combustion chamber 11 thereof, especially with an air ratio of 1.20 to 1.25. Below this limit value, the control device 20, via the manipulated variable for the actuator 21 of the gas valve 17, provides a gas/combustion air mixture with a gas/combustion air ratio which ensures a combustion in the combustion chamber 11 of the gas burner 10, especially with an air ratio of between 1.35 and 1.40.

FIGS. 2 to 4 show diagrams for further illustration of the invention, wherein in FIGS. 2 to 4 a reference value $\Delta p_{SOLL}$ for the pressure difference between the gas pressure and the combustion air pressure is plotted against the rotational speed n of the fan 14 in each case, this being used for determining the manipulated variable for the actuator 21 of the gas valve 17. In FIGS. 2 to 4, above a limit value $n_G$ for the rotational speed n of the fan 14 this reference value $\Delta p_{SOLL}$ is zero in each case so that when the rotational speed of the fan 14 is higher than the limit value $n_G$, a 1:1 gas/air control with a ratio of gas pressure to combustion air pressure of 1:1 is provided. Below the limit value $n_G$ for the rotational speed n of the fan 14, this reference value $\Delta p_{SOLL}$ is reduced in FIGS. 2 to 4, specifically in a single step in FIG. 2, in multiple steps in FIG. 3, and continuously, that is to say linearly, in FIG. 4.

The above adjustments can correspondingly also be applied when the manipulated variable for the actuator 21 of the gas valve 17 is altered in dependence upon the rotational speed of the fan 14.

LIST OF DESIGNATIONS

10 Gas burner
11 Combustion chamber

12 Flame
13 Ionization sensor
14 Fan
15 Combustion air line
16 Gas line
17 Gas valve
18 Gas valve
19 Gas valve
20 Control device
21 Actuator
22 Actuator
23 Sensor

The invention claimed is:

1. A method for operating a gas burner, wherein a gas/combustion air mixture is fed to the gas burner for combusting in said gas burner in such a way that a combustion air flow, which is inducted by a fan, is mixed with a gas flow and the resulting gas/combustion air mixture is fed to the gas burner, wherein to this end a control device, on the basis of a control deviation that is representative of a pressure differential between a gas pressure of a gas line and a combustion air pressure in said burner that is recorded by a pressure sensor providing an electrical or electronic measurement signal, determines a manipulated variable for a gas valve which influences the gas flow, and wherein the gas valve is adjusted in dependence upon this manipulated variable in order to make available to the gas burner the gas/combustion air mixture with a desired gas/combustion air ratio, the method comprising:

the control device operatively coupled to the pressure sensor and configured to determine the manipulated variable in dependence upon the electrical or electronic measurement signal of the pressure sensor and a rotational speed of the fan in such a way that at lower rotational speeds of the fan in comparison to relatively higher rotational speeds of the fan the gas proportion is reduced in relation to the air proportion so that the gas/combustion air ratio becomes leaner in gas.

2. The method according to claim 1, wherein when the rotational speed of the fan is higher than a limit value, the control device determines the manipulated variable so as to provide a first gas/air control with a first ratio of gas pressure to combustion air pressure.

3. The method according to claim 2, wherein when the rotational speed of the fan is higher than the limit value, the control device determines the manipulated variable so as to provide a gas/combustion air mixture with a first ratio, wherein the first ratio ensures a combustion in the gas burner with an air ratio of between 1.20 and 1.25.

4. The method according to claim 2, wherein when the rotational speed of the fan is lower than the limit value, the control determines the manipulated variable so as to provide a 1:N gas/air control with a second ratio of gas pressure to combustion air pressure of 1:N, with N>1.

5. The method according to claim 4, wherein when the rotational speed of the fan is lower than the limit value, the control device determines the manipulated variable so as to provide a gas/combustion air mixture with a second ratio, wherein the second ratio ensures a combustion in the gas burner with an air ratio of between 1.35 and 1.40.

6. The method according to claim 1, wherein the control device continuously determines the manipulated variable in dependence upon the rotational speed of the fan.

7. The method according to claim 1, wherein the control device determines the manipulated variable in a single step or in multiple steps in dependence upon the rotational speed of the fan.

8. A control device for a gas burner for influencing a gas/combustion air mixture which is to be fed to the gas burner, the control device configured such that, on the basis of a control deviation between an actual value, which corresponds to a pressure difference between a gas pressure and a combustion air pressure and which is recorded by a pressure sensor providing an electrical or electronic measurement signal and acting on a gas line which carries the gas flow and a corresponding reference value, determines a manipulated variable for a gas valve;

the control device further configured to determine the manipulated variable in dependence upon the electrical or electronic measurement signal of the pressure sensor and a rotational speed of the fan in such a way that at relatively lower rotational speeds of the fan in comparison to relatively higher rotational speeds of the fan the gas proportion is reduced in relation to the air proportion so that the gas/combustion air ratio becomes leaner in gas.

9. The control device according to claim 8, wherein the controller continuously determines the manipulated variable in dependence upon the rotational speed of the fan.

10. The control device according to claim 8, wherein the controller determines the manipulated variable in a single step or in multiple steps in dependence upon the rotational speed of the fan.

11. A method for controlling a gas burner, wherein the gas burner includes a combustion chamber, a variable speed fan for providing a variable amount of air to the combustion chamber, and a gas valve, the method comprising:

sensing a pressure differential between a gas pressure of a gas line feeding the combustion chamber and a combustion pressure in said combustion chamber;

using the sensed pressure differential, delivering a first gas/combustion air ratio to the combustion chamber with the fan at a first speed; and using the sensed pressure differential, delivering a second gas/combustion air ratio to the combustion chamber with the fan at a second speed, wherein the first gas/combustion air ratio is different from the second gas/combustion air ratio.

12. The method of claim 11, wherein the first gas/combustion air ratio is delivered to the combustion chamber when the first speed is above a threshold fan speed.

13. The method of claim 12, wherein the second gas/combustion air ratio is delivered to the combustion chamber when the second speed is below the threshold fan speed.

14. The method of claim 13, wherein a third gas/combustion air ratio is delivered to the combustion chamber when the fan is at a third speed, different from the second speed, that is also below the threshold fan speed.

* * * * *